US006772835B2

(12) United States Patent
Rogers et al.

(10) Patent No.: US 6,772,835 B2
(45) Date of Patent: Aug. 10, 2004

(54) APPARATUS AND METHOD FOR DISCONNECTING A TAIL PIPE AND MAINTAINING FLUID INSIDE A WORKSTRING

(75) Inventors: Henry E. Rogers, Duncan, OK (US); Michael Dodson, Midland, TX (US); Earl D. Webb, Wilson, OK (US); David D. Szarka, Duncan, OK (US); Frank Acosta, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 37 days.

(21) Appl. No.: 10/230,701

(22) Filed: Aug. 29, 2002

(65) Prior Publication Data

US 2004/0040709 A1 Mar. 4, 2004

(51) Int. Cl.[7] ..... E21B 17/06; E21B 33/13

(52) U.S. Cl. ..... 166/177.4; 166/242.6; 166/242.7; 166/317

(58) Field of Search ..... 166/242.6, 242.7, 166/317, 334.3, 334.4, 332.6, 377, 177.4

(56) References Cited

U.S. PATENT DOCUMENTS

| | | | | | |
|---|---|---|---|---|---|
| 4,105,069 | A | | 8/1978 | Baker | 199/51 |
| 4,570,714 | A | * | 2/1986 | Turner et al. | 166/278 |
| 4,671,361 | A | * | 6/1987 | Bolin | 166/377 |
| 5,044,444 | A | * | 9/1991 | Coronado | 166/387 |
| 5,337,829 | A | * | 8/1994 | Taylor | 166/377 |
| 5,368,103 | A | | 11/1994 | Heathman et al. | 166/289 |
| 5,479,986 | A | | 1/1996 | Gano et al. | 166/292 |
| 5,488,994 | A | | 2/1996 | Laurel et al. | 166/387 |
| 5,566,757 | A | | 10/1996 | Carpenter et al. | 166/285 |
| 5,641,021 | A | | 6/1997 | Murray et al. | 166/291 |
| 5,718,292 | A | | 2/1998 | Heathman et al. | 166/387 |
| 5,762,139 | A | | 6/1998 | Sullaway et al. | 166/291 |
| 5,787,982 | A | * | 8/1998 | Bakke | 166/242.6 |
| 6,053,250 | A | * | 4/2000 | Echols | 166/317 |
| 6,053,262 | A | * | 4/2000 | Ferguson et al. | 175/321 |
| 6,408,946 | B1 | * | 6/2002 | Marshall et al. | 166/317 |

* cited by examiner

*Primary Examiner*—Hoang Dang
(74) *Attorney, Agent, or Firm*—John W. Wustenberg; Warren B. Kice

(57) ABSTRACT

An embodiment of a downhole tool for use with a workstring in a wellbore includes a first section, a second section, and a coupling mechanism adapted such that in a first configuration the coupling mechanism couples the first section to the second section. In a second configuration, the coupling mechanism does not couple the first section to the second section. Also disclosed is a method for creating a plug in a wellbore, the method comprising: injecting a slurry into the workstring to form a plug in the wellbore, positioning a flow preventing mechanism into the workstring to prevent fluid flow from exiting the workstring, inducing a coupling mechanism to uncouple a portion of the workstring such that the portion remains with the slurry to create the plug in the wellbore, and removing the first section from the wellbore.

20 Claims, 3 Drawing Sheets

APPARATUS AND METHOD FOR DISCONNECTING A TAIL PIPE AND MAINTAINING FLUID INSIDE A WORKSTRING

BACKGROUND

This invention pertains to apparatuses and methods of removing tail pipes when conducting downhole operations in boreholes which penetrate subterranean earth formations.

When drilling a borehole which penetrates one or more subterranean earth formations, it may be advantageous or necessary to create a hardened plug in the borehole. Such plugs are used for abandonment of the well, wellbore isolation, wellbore stability, or kick-off procedures. For instance, it is sometimes necessary to change the direction of the borehole as it is being drilled. In order to change direction, a harden mass of cement is often placed in the borehole in the vicinity of the location where the change in drilling direction is to begin. This hardened mass of cement is referred to in the art as a sidetrack plug or as a kickoff plug.

The specific function of a kickoff plug is to cause the drill bit to divert its direction. Accordingly, if the plug is harder than the adjacent formation, then the drill bit will tend to penetrate the formation rather than the plug and thereby produce a change in drilling direction. However, a kickoff plug may fail to cause the drill bit to change direction if the plug is unreasonably contaminated with a foreign material, such as drilling mud or fluid. Drilling fluid, when mixed in the unset cement, can render the set mass softer than the adjacent formation. Thus, extreme care and expense is usually taken to make sure that the drilling fluid does not mix with the cement plug.

Typically, a cement plug may be set in a borehole by pumping a volume of spacer fluid compatible with the drilling mud and cement slurry into the workstring. Then a predetermined volume of cement slurry is pumped behind the spacer fluid. The cement slurry travels down the workstring and exits into the wellbore to form the plug. The cement slurry typically exits through one or more openings located at the end of the workstring. In this context, the end of the workstring is usually referred to as the "tail pipe." Drilling fluid is usually pumped behind cement slurry to maintain pressure within the workstring.

At this point, the workstring is raised within the wellbore to permit the entire volume of cement slurry inside the conduit to flow out of the bottom of the tail pipe. However, the tail pipe must be raised very slowly or the cement slurry and the drilling fluid will mix, which may destroy the integrity of the plug. The process of raising the tail pipe generally causes some damage to the plug because as the tail pipe is raised the drilling fluid in the workstring mixes with the cement slurry. What is needed therefore, is a method and apparatus to keep the drilling fluid in the tail pipe from mixing with the cement slurry as the tail pipe is removed.

DETAILED DESCRIPTION

Figure 1:
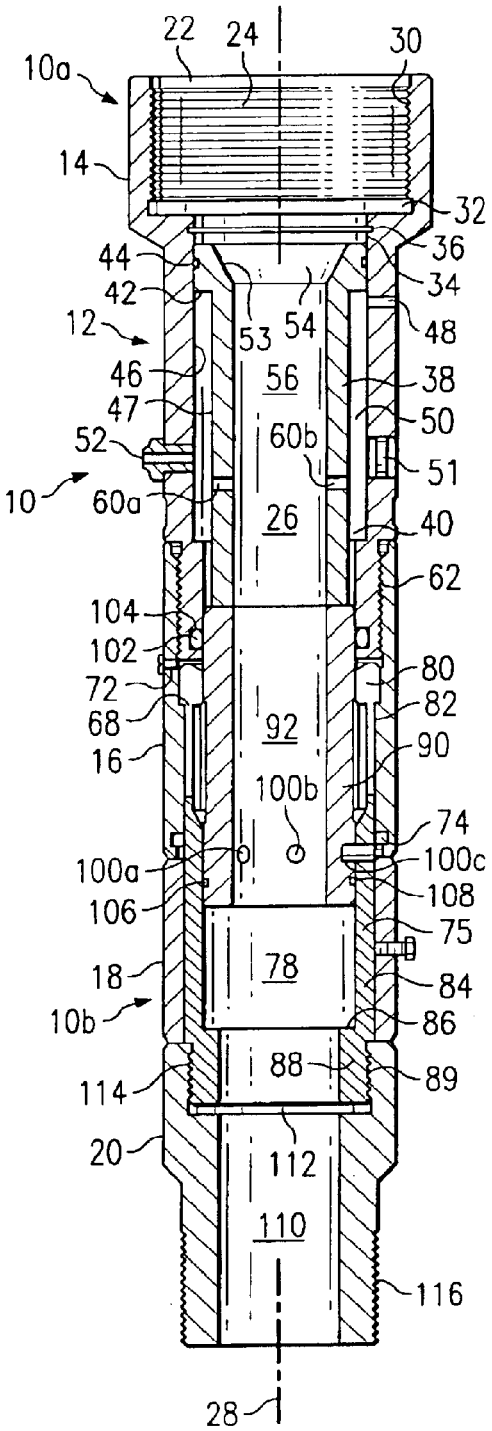
FIG. 1 is a longitudinal cross section of one embodiment of the present invention showing the embodiment in a running configuration.
Figure 2:
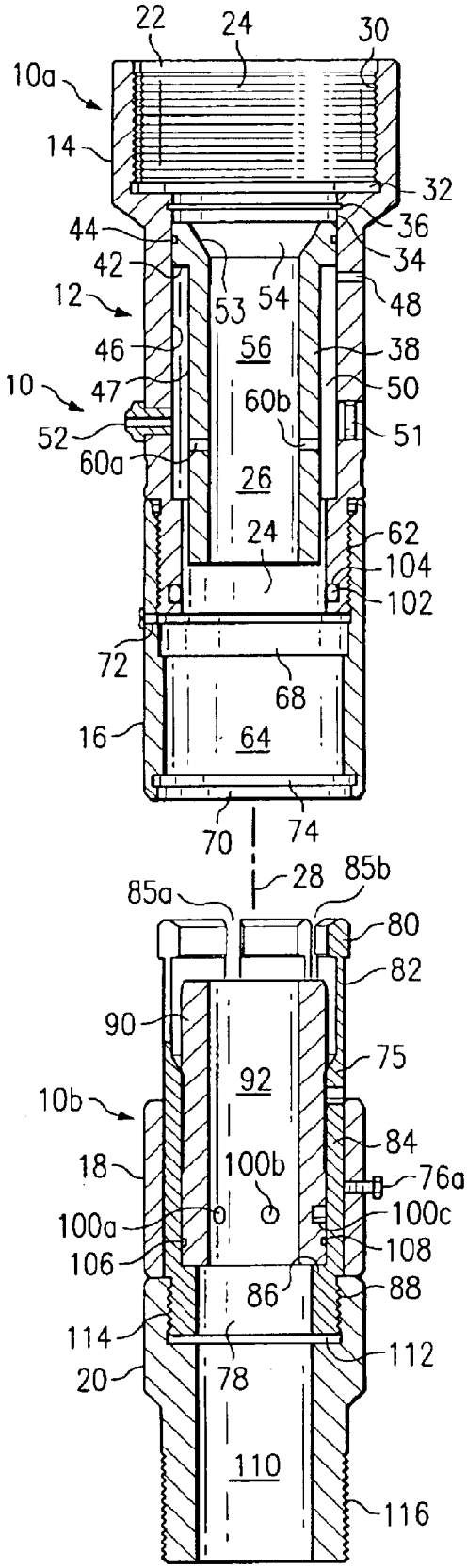
FIG. 2 is a longitudinal cross section of the embodiment of FIG. 1 showing the embodiment in a disconnected configuration.

Referring now to FIGS. 1 and 2, there is a downhole or tubing release tool 10. As will be explained below with reference to the operation of the tubing release tool 10, the tubing release tool 10 comprises a first or "upper" tubular section 10*a* and a second or "lower" tubular section 10*b*. FIG. 1 illustrates a first or "running" configuration where the upper section 10*a* and lower section 10*b* are coupled together. In contrast, FIG. 2 illustrates a second or "disconnected" configuration where the upper section 10*a* and lower section 10*b* are separated. As will be explained in detail below, a coupling mechanism is provided such that in the running configuration the coupling mechanism couples the upper section 10*a* to the lower section 10*b*, and in the disconnected configuration the coupling mechanism does not couple the upper section 10*a* to the lower section 10*b*. The individual components of the tubing release tool 10 will now be discussed with reference to both FIG. 1 and FIG. 2.

The tubing release tool 10 has an outer housing 12 which is generally cylindrical in shape and encloses the various modules and components of one embodiment of the present invention. In the illustrative embodiment, the upper end of the outer housing 12 is comprised of an upper connecting body 14. The upper connecting body 14 connects to a collet retainer 16. In the running configuration, the collet retainer 16 is disposed above a spacer housing 18, but the collet retainer 16 does not directly connect to the spacer housing 18. A lower connecting body 20 is positioned below the spacer housing 18. Thus, in the running configuration, the outer housing 12 comprises the upper connecting body 14, collet retainer 16, spacer housing 18, and lower connecting body 20.

The Upper Section:

A top end of the upper connecting body 14 defines a top opening 22. The top opening 22 is a top end of a concentric bore 24 that runs longitudinally through the upper connecting body 14. The top opening 22 also defines a top of fluid passageway or central bore 26 which generally runs entirely through the tubing release tool 10 along a longitudinal axis 28. Thus, the bore 24 forms a top portion of the central bore 26.

The upper connecting body 14 may be adapted for connecting to a workstring (not shown in FIG. 1 or FIG. 2) in a conventional manner. For instance, in the illustrated embodiment, the upper connecting body 14 has an interior threaded surface 30 to connect to the workstring. The illustrative embodiment also has an annular groove 32 defined in the bore 24 below the interior threaded surface 30. The annular groove 32 is a relief space to allow internal threads to be cut in the upper connecting body 14. A lock ring 34 is positioned in another annular groove 36, which is located below annular groove 32. The diameter of the bore 24 remains constant below the annular groove 36 until the diameter of the bore 24 abruptly narrows to create an upward facing shoulder or seat 40 within the bore 24.

The lock ring 34 holds a secondary releasing sleeve 38 in place during assembly. The secondary releasing sleeve 38 is a cylindrical shaped sleeve which is slidably disposed within the bore 24. As will be explained below with reference to the operation of the tubing release tool 10, the secondary releasing sleeve 38 slidably moves along the axis 28 within the bore 24. A top end of the secondary releasing sleeve 38 has an exterior rim 42, the diameter of which is slightly smaller than the interior diameter of the bore 24. A sealing means, such as an O-ring 44 provides a sealing engagement between the rim 42 and an interior surface 46 of the bore 24.

In some embodiments, the upper connecting body 14 has a screw hole 48 which allows a user to fill a cavity 50 with a lubricating agent, such as grease. The cavity 50 is defined by a space between the interior surface 46 and an exterior surface 47 of the secondary releasing sleeve 38. The secondary releasing sleeve 38 may have one or more longitudinal grooves (not shown) defined within its exterior surface 47 to create a flow path for the lubricating agent. Consequently, as the secondary releasing sleeve 38 travels longitudinally, the lubricating agent can escape. Without such longitudinal grooves, the secondary releasing sleeve 38 could become fluid locked and unable to travel.

In other embodiments, the upper connecting body 14 may be fitted with a fluid releasing device, such as a rupture disk assembly 51 that is ruptured at a predetermined pressure level. As will be explained in greater detail later, the rupture disk assembly 51 allows some of the drilling fluid in the workstring to escape after the cementing is completed. Consequently, the operator does not have to pull up a workstring full of drilling fluid. In yet other embodiments, the upper connecting body 14 may also be fitted with a pressure monitoring mechanism, such as a nozzle 52. The nozzle 52 allows a controlled amount of fluid to escape which allows the operator to monitor the backpressure inside of the tubing release tool 10.

At the top end of the secondary releasing sleeve 38 there is a radially inwardly beveled surface 53 which defines an opening 54. The opening 54 turns into a top end of a concentric bore 56 that generally runs longitudinally through the secondary releasing sleeve 38. The bore 56 is in communication with the bore 24 of the upper connecting body 14 and also forms a portion of the central bore 26. The secondary releasing sleeve 38 may also have one or more vent ports 60*a* and 60*b* to allow the lubricating agent to flow into bore 56, indicating the cavity 50 is filled to capacity.

In the illustrative embodiment, the upper connecting body 14 couples to the collet retainer 16 via a threaded connection 62. A concentric bore 64 (FIG. 2) runs longitudinally through the collet retainer 16. Below the threaded connection 62, the bore 64 abruptly narrows in a radial inward direction to create an inwardly protruding circumferential lip or seat 68.

The collet retainer 16 may have at least one screw hole 72 which allows a user to lubricate the bore 64 with a lubricating agent, such as grease. A one-way seal, such as a debris seal 74 may be positioned within an annular groove 70 which is defined in the bore 64 at a predetermined distance below the seat 68. The debris seal 74 is used during the running configuration to allow the lubricating agent to escape, and to prevent drilling fluid from seeping into the bore 64.

Thus, in the illustrative embodiment, the upper section 10*a* includes the upper connecting body 14, the collet retainer 16, and the secondary releasing sleeve 38.

The Lower Section:

As explained previously, the spacer housing 18 is disposed below the collet retainer 16 (of the upper section 10*a*) when in the running configuration. The spacer housing 18 is generally in the shape of a hollow cylinder. The interior diameter of spacer housing 18 is slightly larger than the exterior diameter of a releasing collet 75 such that the spacer housing 18 surrounds a portion of collet 75. In the illustrated embodiment, the spacer housing 18 also has two screw holes 76*a* and 76*b* (screw hole 76*b* is not shown) to hold the spacer housing 18 on the collet 75 during assembly.

The collet 75 is generally cylindrical shaped and has a concentric bore 78 running longitudinally through the collet 75. In the running configuration (FIG. 1), a lower portion of the bore 78 becomes a portion of the central bore 26. At a top end of the collet 75, there is an outwardly protruding rim 80 which circumferentially extends around the top end of collet 75. Below the rim 80, there is a flexible or top section 82 of the collet 75. Below the top section 82, there is a lower section 84 of the collet 75. The wall thickness of the top section 82 is narrow relative to the lower section 84. There are also a predetermined number of longitudinal slots extending from the top of the rim 80 through the top section 82. For instance, slots 85*a* and 85*b* are shown in FIG. 2. Preferably these slots will be equally spaced around the periphery of the rim 80. As will be explained below in relation to the operation of the tubing release tool 10, the combination of the slots 85*a* and 85*b* and the narrowed wall thickness of the top section 82 allow the diameter of the rim 80 to decrease when the rim 80 is not radially supported by a supporting mechanism. Thus, the rim 80 can be considered "flexible" in that it can contract from a first radial position of a particular diameter to a second radial position of a lesser diameter.

The interior of the lower section 84 of the collet 75 abruptly narrows to create an upward facing shoulder or seat 86. The lower section 84 has external threads 88 to mate with interior threads 89 of the lower connecting body 20.

A support mechanism, such as a primary releasing sleeve 90 is slidably disposed within the bore 78 of the collet 75. The primary releasing sleeve 90 is generally cylindrical in shape and has a concentric bore 92 running along the primary releasing sleeve's 90 longitudinal axis. In the running configuration (FIG. 1), the bore 92 is in communication with the bore 56 of the secondary releasing sleeve 38 and is a portion of the central bore 26. The exterior diameter of the primary releasing sleeve 90 is slightly smaller than the diameter of the bore 78 of the collet 75. In the running configuration, primary releasing sleeve 90 "radially supports" the collet 75 in that it prevents the rim 80 from radially contracting to a smaller diameter.

As illustrated in FIG. 1, the primary releasing sleeve 90 is in a first position. The primary releasing sleeve 90 is maintained in this first position by a positioning mechanism, such as a shearing mechanism. In the illustrative embodiment, the shearing mechanism is a plurality of radially spaced shear pins 100*a* through 100*c* which extends through the primary releasing sleeve 90 and the collet 75. In other embodiments, the shearing mechanism could be a single shear pin. The shear mechanism is shearable at a predetermined force, which in the illustrative embodiment, is applied by the primary releasing sleeve 90. As will be explained below in relation to the operation of the tubing release tool 10, once the shear pins 100*a* through 100*c* have sheared, thus disabling the positioning mechanism, the primary releasing sleeve 90 is free to slidably move along the longitudinal axis 28 to a second position, which is illustrated in FIG. 2.

In the running configuration (FIG. 1), there is a means to provide a sealing engagement between the exterior of the primary releasing sleeve 90 and an interior surface of the bore 24 of the upper connecting body 14. In the illustrative embodiment, this sealing means is an O-ring 102 positioned in an annular groove 104, which is defined in the bore 24. Similarly, there is also a sealing means providing a sealing engagement between the exterior of the primary releasing sleeve 90 and an interior surface of the bore 78 of the collet 75. This sealing means may be an O-ring 106 positioned within an annular groove 108 of the exterior surface of the primary releasing sleeve 90.

As discussed above, the lower connecting body 20 is disposed below the spacer housing 18 and connects to the collet 75. The lower connecting body 20 is generally cylindrical in shape and also has a concentric bore 110 running along its longitudinal axis. The bore 110 is in communication with the bore 78 of the collet 75 and is a portion of the central bore 26. The lower connecting body 20 has a top opening 112 which is adapted to mate with the external threads 88 of the collet 75 via internal threads 114. The lower connecting body 20 may also be adapted to connect in a conventional manner to another downhole tool which may be positioned lower in the workstring than the tubing release tool 10. For instance in the illustrative embodiment, the lower connecting body 20 has external threads 116 designed to mate with another workstring tool (not shown). In the illustrative embodiment, the exterior diameter of the lower connecting body 20 also narrows to allow the other workstring tool to conveniently mate with the lower connecting body 20.

In sum, in the illustrative embodiment, the lower section 10*b* includes the primary releasing sleeve 90, the collet 75, the spacer housing 18, and the lower connecting body 20.

Operation of the Invention

Figure 3A:
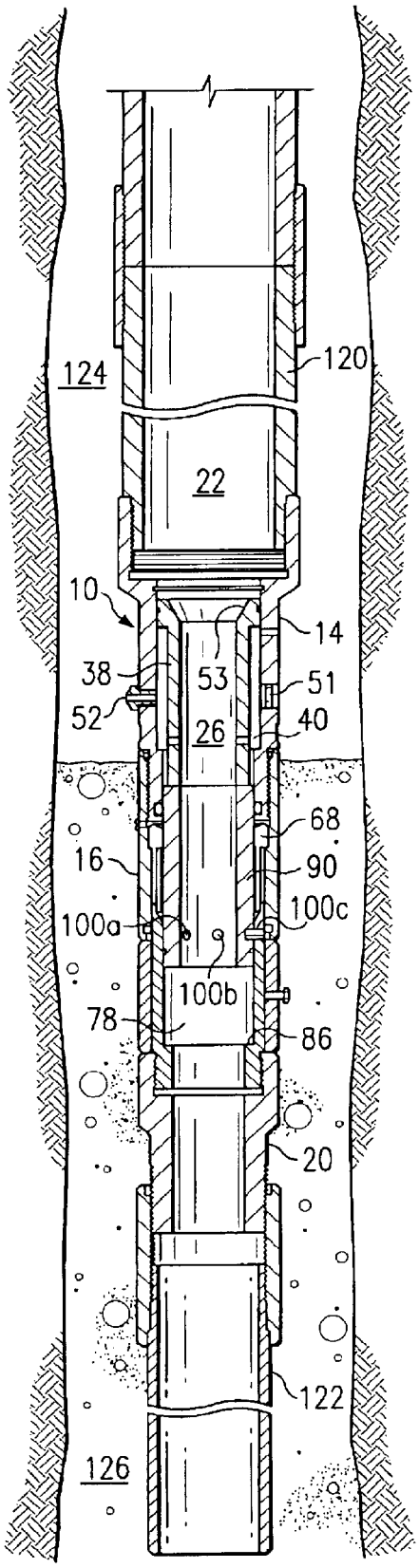
FIG. 3*a* is a cross section of one embodiment of the present invention in a wellbore when the embodiment is in a running configuration.
Figure 3B:
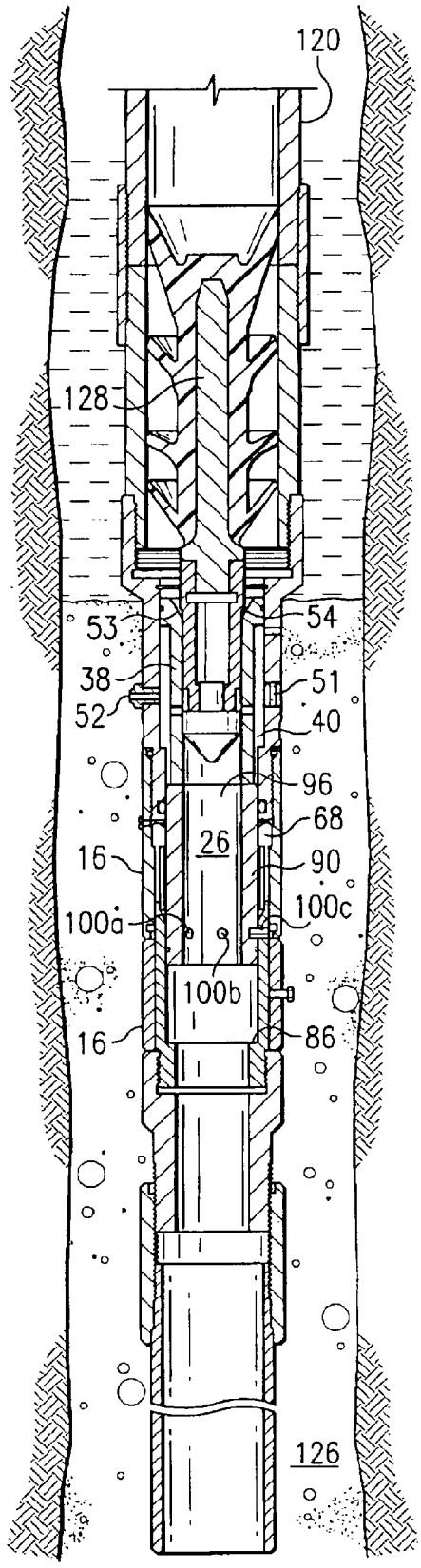
FIG. 3*b* is a cross section of the embodiment of FIG. 3*a* showing the embodiment with a plug.
Figure 3C:
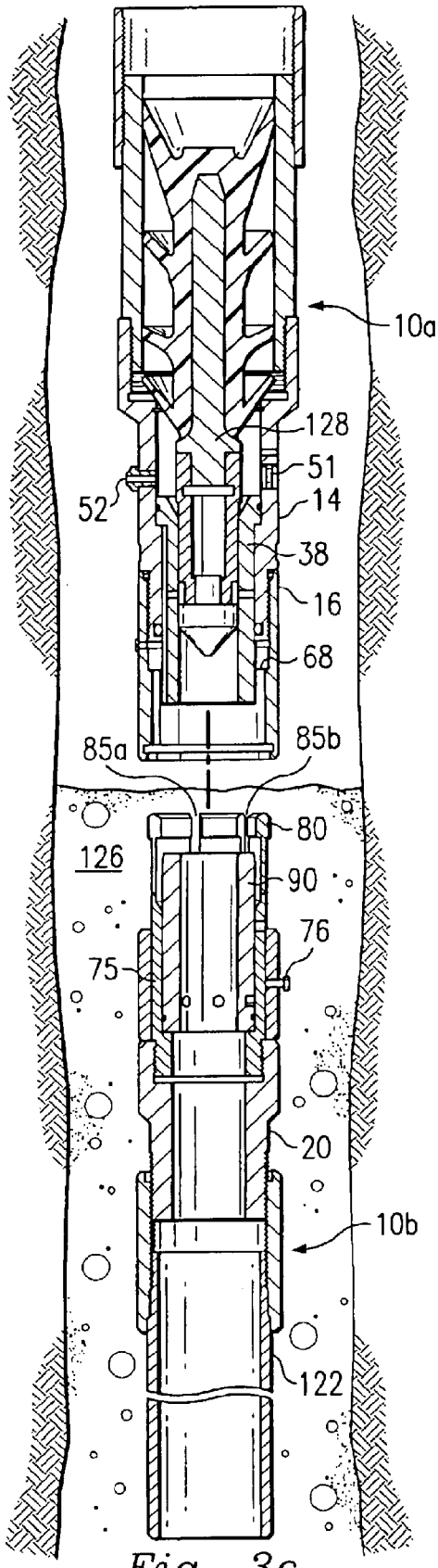
FIG. 3*c* is a cross section of the embodiment of FIG. 3*a* showing the embodiment in a disconnected configuration.

Referring to FIGS. 3*a* through 3*c*, the operation of the tubing release tool 10 will now be discussed. In operation, the upper connecting body 14 of the tubing release tool 10 is connected to a workstring 120. In the illustrative embodiment, the lower connecting body 20 is also connected to an extension tube 122. The entire workstring is then lowered into a wellbore 124. Drilling fluid is circulated through the workstring 120 and the tubing release tool 10 as it is lowered into the wellbore 124. Once the tubing release tool 10 reaches the desired depth, a volume of spacer fluid compatible with the drilling fluid may be introduced into the workstring 120.

A predetermined volume of cementitious fluid, such as cement slurry can then be pumped behind the spacer fluid. The cementitious fluid may be comprised of any slurry capable of forming a hardened plug. For instance, cement slurry may be comprised of cement and sufficient water to form a pumpable slurry. The cement slurry may also include additives to accelerate the hardening time, to combat or otherwise prevent fluid loss and gas migration, and to resist loss in compressive strength caused by high downhole temperatures. Such cementitious fluids and slurry compositions are well known in the art.

The cement slurry will flow through the workstring 120 and enters the tubing release tool 10 through the top opening 22 of the upper connecting body 14. The cement slurry flows through the central bore 26 and into the extension tube 122. The cement slurry exits the extension tube 122 into the wellbore 124. The cement slurry will fill a portion of the wellbore 124 to create a cementitious plug 126 at the desired depth within the wellbore 124.

At this point, it is desirable to switch from the running configuration to the disconnected configuration. In the running configuration, the collet 75 acts as the coupling mechanism between the upper section 10*a* and the lower section 10*b* of the tubing release tool 10. The coupling or connection between the upper section 10*a* and the lower section 10*b* occurs because the diameter of the rim 80 of the collet 75 is larger than the diameter of the lip 68 of the collet retainer 16. Thus, as long as the exterior diameter of the rim 80 is larger than the interior diameter of the lip 68, the collet 75 is "retained" in the bore 64 of the collet retainer 16. On the other hand, if the exterior diameter of the rim 80 becomes smaller than the interior diameter of the lip 68, there is nothing to prevent the collet 75 from slipping past the lip 68 and out of the collet retainer 16.

In order to switch from the running configuration to the disconnected configuration, a flow prevention mechanism may be introduced into the workstring 120. Referring now to FIG. 3*b*, a plug 128 has been introduced into the workstring 120 and has moved downward within the workstring 120 by drilling fluid which is introduced behind the plug 128. The plug 128 may be any conventional plug, such as drill pipe dart or phenolic ball that would provide a hydraulic seal upon reaching the secondary releasing sleeve 38. The plug 128 could also be a combination of plugs or balls. For instance, a foam ball (not shown) could be introduced into the workstring 120 to clean or wipe the inside of the workstring 120. Then, a phenolic ball (not shown) could be introduced to begin the disconnecting procedure (as will be explained below). The combination of the foam ball and the phenolic ball could act as the plug 128.

When the plug 128 engages the tubing release tool 10, the plug 128 moves through the central bore 26 until it sealingly engages the opening 54 of the secondary releasing sleeve 38 such that the drilling fluid behind the plug 128 is prevented from exiting the workstring 120. Backpressure is thereby increased as additional drilling fluid is pumped into the workstring 120.

The backpressure inside the workstring 120 causes the plug 128 to exert an axial force on the beveled surface 53 of the secondary releasing sleeve 38. In response, the secondary releasing sleeve 38 pushes on the primary releasing sleeve 90, transferring the axial force from the secondary releasing sleeve 38 to the primary releasing sleeve 90. In turn, the primary releasing sleeve 90 exerts a shearing force on the shearing pins 100*a* through 100*c* which are maintaining the primary releasing sleeve 90 in the first position within the bore 78. Thus, when the backpressure inside the workstring 120 reaches a first predetermined pressure, the shear force exerted on the shear pins 100*a* through 100*c* will be great enough to cause the shear pins 100*a* through 100*c* to fail. This shearing allows the releasing sleeves 38 and 90 to move longitudinally downward until the primary releasing sleeve 90 rests on the seat 86. In some embodiments, the secondary releasing sleeve 38 is vertically supported by the primary releasing sleeve 90. Thus, when the primary releasing sleeve 90 moves longitudinally downward, the secondary releasing sleeve 38 will also move downward until the rim 42 engages the seat 40 of the upper connecting body 14 as shown in FIG. 3*c* and FIG. 2.

As discussed previously, longitudinal slots 85*a* and 85*b* in the top section 82 of the collet 75 allow the rim 80 to move in a radially inward direction when the rim 80 is not radially supported by the primary releasing sleeve 90. Thus, once the primary releasing sleeve 90 has moved downward from a first position (as shown in FIG. 3*b*) to a second or lower position (as shown in FIG. 3*c*), the rim 80 is no longer radially supported and is free to move inwardly in a radial direction. When the rim 80 moves inwardly, it no longer engages the seat 68 of the collet retainer 16. When the seat 68 is no longer engaged with the rim 80, the upper section 10*a* of the tubing release tool 10 is no longer coupled to the lower section 10*b*. The hydraulic force applied to secondary releasing sleeve 38, forces lower section 10*b* free from upper section 10*a*, completing the uncoupling or disconnect between the upper section 10*a* and the lower section 10*b*.

Once the upper section 10*a* is no longer coupled to the lower section 10*b*, the workstring 120 may be removed. The lower section 10*b* will remain in the cementitious plug 126 and the upper section 10*a* will remain connected to the workstring 120, and thus, will be removed as the workstring 120 is removed. Turning now to FIG. 3*c*, as the workstring 120 is moved up, the plug 128 sealingly engages the beveled surface 53 of the secondary releasing sleeve 38 such that the drilling fluid in the workstring 120 will remain in the workstring 120. Thus, as the workstring 120 is raised, the drilling fluid will not intermix with the cement slurry nor apply a hydrostatic load to the cementitious plug 126. The operator, therefore, may significantly reduce current precautions to decrease the intermixing of the drilling fluid with the cement slurry, such as waiting for several hours for the cement slurry to thicken. The cement slurry is, therefore, free to set into a hard impermeable mass.

Once the disconnect is completed, the operator may remove a portion of the wet workstring 120 or wait a predetermined length of time, for instance 20 to 30 minutes until the cementitious plug 126 begins to harden. At that point, continued pumping of drilling fluid will create an increase in backpressure of the workstring 120. When the back pressure reaches a second predetermined pressure, such as 4000 psi, the rupture disk assembly 51 will rupture, allowing the drilling fluid to exit from the side of the tubing release tool 10 through the rupture disk assembly 51. By allowing the drilling fluid to exit the tubing release tool 10, the operator avoids pulling up the workstring 120 when it is full of drilling fluid.

Although only a few exemplary embodiments of this invention have been described in detail above, those skilled in the art will readily appreciate that many modifications are possible in the exemplary embodiments without materially departing from the novel teachings and advantages of this invention. For instance, the use of the nozzle 52 allows the operator to monitor the backpressure inside of the tubing release tool 10. When the lower section 10*b* disconnects from the upper section 10*a*, there will be a momentary drop in pressure within the tubing release tool 10. By monitoring the backpressure, the operator can determined when disconnect occurs.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A downhole tool for attaching to a workstring in a wellbore, the downhole tool comprising:

a first section defining a first bore in communication with the workstring;

a second section defining a second bore;

a collet coupled to the second section and adapted to contract radially from a first radial position to a second radial position, wherein in the first radial position the collet is adapted to couple to the first section, and wherein in the second radial position the collet does not couple to the first section;

a support mechanism slidably coupled to the collet and adapted to radially support the collet to prevent the collet from radially contracting from the first radial position to the second radial position;

a sleeve disposed within the first section and adapted to slidably move and exert a pressure on an end of the support mechanism;

a positioning mechanism coupled to the support mechanism for keeping the support mechanism in a position such that the support mechanism prevents the collet from radially contracting from the first radial position until a predetermined condition occurs, wherein a predetermined axial force placed on the support mechanism can shear the positioning mechanism, thus allowing the support mechanism to move such that the collet radially contracts from the first radial position to the second radial position; and a fluid releasing device adapted to selectively place the first bore in communication with the wellbore so that fluid contained in the workstring can either be retained in the workstring or released into the wellbore after the first section is uncoupled from the second section.

2. A downhole tool for attaching to a workstring in a wellbore, the downhole tool comprising:

a first section defining a first bore in communication with the workstring;

a second section defining a second bore;

a collet coupled to the second section and adapted to contract radially from a first radial position to a second radial position, wherein in the first radial position the collet is adapted to couple to the first section, and wherein in the second radial position the collet does not couple to the first section;

a support mechanism slidably coupled to the collet and adapted to radially support the collet to prevent the collet from radially contracting from the first radial position to the second radial position;a positioning mechanism coupled to the support mechanism for keeping the support mechanism in a position such that the support mechanism prevents the collet from radially contracting from the first radial position until a predetermined condition occurs;

a fluid releasing device adapted to selectively place the first bore in communication with the wellbore so that the fluid contained in the workstring can either be retained in the workstring or released into the wellbore after the first section is uncoupled from the second section;

an inwardly protruding circumferential lip disposed within the first bore of the first section; and an outwardly protruding circumferential rim positioned on the collet and adapted to couple with the lip when the collet is in the first radial position.

3. The downhole tool of claim 1 or 2 wherein the collet has a flexible section which is adapted to contract in a radial direction.

4. The downhole tool of claim 3 wherein the flexible section has a predetermined number of slots running through a wall of the collet to allow the collet to contract radially.

5. The downhole tool of claim 3 wherein the support mechanism is a sleeve.

6. The downhole tool of claim 1 or 2 wherein the positioning mechanism is at least one shear pin.

7. The downhole tool of claim 1 wherein the sleeve is adapted to sealingly engage a flow prevention mechanism to prevent fluid flow through the first bore.

8. A downhole tool for attaching to a workstring in a wellbore, the downhole tool comprising:

a first section defining a first bore in communication with the workstring;

a second section defining a second bore;

a coupling mechanism adapted such that in a first configuration the coupling mechanism couples the first section to the second section and the first bore is in communication with the second bore, and such that in a second configuration the coupling mechanism does not couple the first section to the second section;

a fluid releasing device adapted to selectively place the first bore in communication with the wellbore so that fluid contained in the workstring can either be retained in the workstring or released into the wellbore after the first section is uncoupled from the second section; and a monitoring mechanism coupled to the first section for determining when the coupling mechanism has shifted from the first configuration to the second configuration.

9. The downhole tool of claim 8 wherein the monitoring mechanism is a nozzle positioned through a side of the first section.

10. A downhole tool for attaching to a workstring in a wellbore, the downhole tool comprising:

a first section defining a first bore in communication with the workstring;

a second section defining a second bore;

a coupling mechanism adapted such that in a first configuration the coupling mechanism couples the first section to the second section and the first bore is in communication with the second bore, and such that in a second configuration the coupling mechanism does not couple the first section to the second section; and a rupture disk adapted to rupture at a predetermined pressure to selectively place the first bore in communication with the wellbore so that fluid contained in the workstring can either be retained in the workstring or released into the wellbore after the first section is uncoupled from the second section.

11. The downhole tool of claim 1, 2, 8, or 10, wherein the first section is adapted to sealingly couple with a flow retention device to prevent fluid flow through the first bore.

12. A downhole tool for attachment in a workstring In a wellbore, the downhole tool comprising:

a tubular section adapted to couple to the workstring;

a collet defining a central bore and having a longitudinal axis, wherein the collet is adapted to couple to the tubular section;

a sleeve coupled to the collet, wherein the sleeve is adapted to slidably move along the longitudinal axis between a first position and a second position, wherein in the first position the sleeve radially supports the collet in a coupling configuration with the tubular section, and wherein in the second position the sleeve does not radially support the collet;

a positioning mechanism coupled to the sleeve and to the collet such that the sleeve is retained by the positioning mechanism in the first position until a predetermined condition occurs; and a fluid releasing device coupled to the tubular section, wherein the fluid releasing device is in communication with the workstring and is adapted for selectively releasing fluid from the workstring after the predetermined condition occurs.

13. The downhole tool of claim 12 wherein the collet is adapted to contract radially from a first radial position to a second radial position, wherein in the first radial position the collet is in the coupling configuration, and wherein in the second radial position the collet is not in the coupling configuration.

14. The downhole tool of claim 13 further comprising:

an inwardly protruding circumferential lip coupled to the workstring; and an outwardly protruding circumferential rim positioned on the collet, wherein the rim is adapted to couple with the lip when the collet is in the first radial position.

15. The downhole tool of claim 14 wherein the rim is adapted to be flexible in a radial direction such that the lip can radially contract from the first radial position to the second radial position.

16. The downhole tool of claim 15 wherein the collet has a plurality of slots running through the rim and a portion of a wall of the collet to allow the rim to contract radially.

17. The downhole tool of claim 13 wherein a predetermined axial force placed on the sleeve can shear the positioning mechanism, thus allowing the sleeve to move such that the collet radially contracts from the first radial position to the second radial position.

18. The downhole tool of claim 17 wherein the predetermined condition is an increase in pressure in the workstring which causes the predetermined axial force.

19. The downhole tool of claim 12 further comprising a collet retainer coupled to the tubular section such that when the collet is axially supported by the sleeve, the collet is able to maintain a coupling with the collet retainer, and such that when the collet is not radially supported by the sleeve, the collet is not able to maintain the coupling with the collet retainer.

20. The downhole tool of claim 12 further comprising a pressure monitoring mechanism coupled to the tubular section for determining when the predetermined condition occurs.

* * * * *